United States Patent [19]

Moriyama et al.

[11] 4,313,411

[45] Feb. 2, 1982

[54] FUEL FEEDING DEVICE FOR AN INTERNAL COMBUSTION ENGINE

[75] Inventors: Akinobu Moriyama, Yokosuka; Mitsumasa Inoue, Yokohama; Masaaki Saito, Yokosuka; Yoshihisa Kawamura, Fujisawa, all of Japan

[73] Assignee: Nissan Motor Company, Yokohama, Japan

[21] Appl. No.: 82,335

[22] Filed: Oct. 5, 1979

[30] Foreign Application Priority Data

Oct. 9, 1978 [JP] Japan ..... 53-124420
Nov. 22, 1978 [JP] Japan ..... 53-161216[U]

[51] Int. Cl.[3] ..... F02M 61/14

[52] U.S. Cl. ..... 123/445; 123/470; 123/588; 123/590; 261/39 B; 261/55; 261/117; 261/DIG. 39; 261/DIG. 82

[58] Field of Search ..... 123/585–590, 123/470, 472, 478, 445, 457, 463; 261/117, 39 B, DIG. 39, DIG. 82, 55

[56] References Cited

U.S. PATENT DOCUMENTS

| | | | |
|---|---|---|---|
| 2,868,185 | 1/1959 | Bellicardi | 261/39 B X |
| 3,661,129 | 5/1972 | Uozumi et al. | 123/533 |
| 3,943,904 | 3/1976 | Byrne | 123/336 X |
| 4,084,565 | 4/1978 | Dorsch | 123/382 |
| 4,121,549 | 10/1978 | Martin et al. | 123/590 X |
| 4,167,158 | 9/1979 | Martin et al. | 123/590 X |
| 4,175,521 | 11/1979 | Hattori et al. | 123/589 |
| 4,186,708 | 2/1980 | Bowler | 123/445 X |
| 4,187,821 | 2/1980 | Zebli | 123/588 X |
| 4,253,441 | 3/1981 | Kawamura et al. | 123/445 |

FOREIGN PATENT DOCUMENTS

| | | |
|---|---|---|
| 6604865 | 5/1967 | Fed. Rep. of Germany . |
| 2032902 | 1/1972 | Fed. Rep. of Germany . |
| 2057308 | 5/1972 | Fed. Rep. of Germany . |
| 1776239 | 4/1974 | Fed. Rep. of Germany . |
| 2646695 | 4/1977 | Fed. Rep. of Germany . |
| 325241 | 4/1903 | France . |
| 1190651 | 10/1959 | France . |
| 2379707 | 1/1978 | France . |
| 544048 | 3/1942 | United Kingdom . |
| 617239 | 2/1949 | United Kingdom . |
| 910342 | 11/1962 | United Kingdom . |
| 969181 | 9/1964 | United Kingdom . |
| 1132939 | 11/1968 | United Kingdom . |
| 1536307 | 12/1978 | United Kingdom . |

*Primary Examiner*—Tony M. Argenbright
*Attorney, Agent, or Firm*—Schwartz, Jeffery, Schwaab, Mack, Blumenthal & Koch

[57] ABSTRACT

There is disclosed a fuel feeding device for an internal combustion engine equipped with an air regulator for feeding air through a bypass around a throttle valve and a fuel jetting valve for feeding fuel. An air passage outlet of said air regulator is open opposite to and facing said fuel jetting valve. The opening degree of said air regulator is controlled by a coil bimetal functioning in proportion to the temperature of the engine or through a step motor being driven through a controlling circuit detecting operation conditions of the engine.

6 Claims, 8 Drawing Figures

FUEL FEEDING DEVICE FOR AN INTERNAL COMBUSTION ENGINE

BACKGROUND OF THE INVENTION

The present invention relates to a fuel feeding device for multi-cylinder internal combustion engines and, more particularly, to an electronically controlled fuel jetting device of the single point injection type in which fuel is supplied to such an engine through a single fuel jetting valve.

An average size of fuel particles produced by prior art fuel jetting devices was about 600μ. This degree of atomization was not sufficient to provide suitable fuel distributions and air-fuel ratios for all cylinders when only a single jet was used.

This was particularly true when the engine is cold, the results including misfiring and backfiring of the engine and other signs of reduced performance.

Previous attempts to correct such drawbacks by using a heater in combination with a flat bimetal strip were not completely successful as the bimetal was cooled by intake air inspired because it was located inside the intake passage. Attempts to use a wax device were hampered by the fact that the device could not be made small enough to be mounted on the intake manifold (which we will refer to as a "throttle body"). The accuracy of flow characteristics could not be made to be less than ±5%, which was not sufficient.

Prior Art devices were also often designed so that pressurized fuel flowed from a pressure regulator to a jet via metal or rubber tubing. This arrangement had several disadvantages, including difficulty in fabrication due to the complexity of the structure and the decreased reliability due to a number of connections involved.

SUMMARY OF THE INVENTION

Therefore, it is an object of this invention to provide a fuel feeding device for an internal combustion engine, including means for metering and distributing a fuel and air mixture with an accuracy greater than in prior art single point injection systems, in part by improving the atomization of the fuel.

It is another object of this invention to provide a fuel feeding device for suitably adjusting the air/fuel mixture when the engine is cold in a way that more accurately reflects engine conditions.

It is a further object of this invention to provide a device which is compact enough to be mounted directly on the outside of the passage housing.

It is a further object of this invention to provide a fuel feeding device in which it is possible to eliminate tubing between the fuel pressure regulator and the jetting valve, and eliminate the need for supports for the said valve.

According to this invention, there is provided a fuel feeding device for a multi-cylinder type internal combustion engine, comprising: an intake passage; a throttle valve provided within said intake passage; a bypass formed around said throttle valve said bypass having its one end opening into said intake passage upstream of said throttle valve and the other end opening into the intake passage downstream thereof; an air regulator for regulating air flow through said bypass; a valve for jetting fuel into said intake passage downstream of said throttle valve; and an air passage outlet formed at the other end of said bypass, being located opposite to and facing said jetting valve. The opening degree of said air regulator is controlled by a coil-shaped bimetal functioning in proportion to the engine temperature, a thermal insulator being provided between said bypass and a chamber for housing said bimetal. Otherwise, the opening degree of said air regulator is controlled by a step motor which is driven through a control circuit for detecting the engine conditions. An atomizer may be placed between a nozzle of said jetting valve and said outlet of said bypass in such a way that a portion of the fuel jetted from said jetting valve strikes said atomizer. A pressure regulator may be provided for regulating the fuel jetting pressure, which is integrally fixed to the intake passage throttle body. The front and rear ends of said fuel jetting valve are held between said throttle body and the body of said pressure regulator. The upstream end of said fuel jetting valve is inserted in a fuel feeding passage of said pressure regulator along the axial direction thereof to be connected therewith.

DETAILED DESCRIPTION OF THE PREFERRED EMBODIMENT

Figure 1:
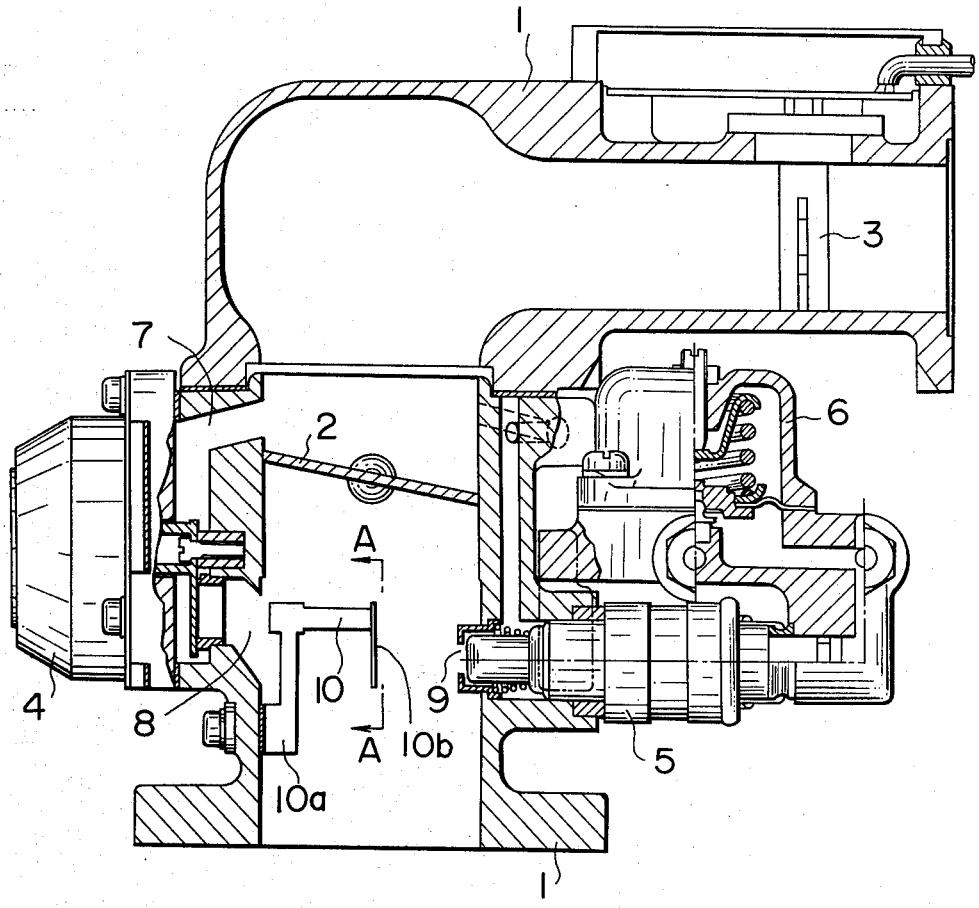
FIG. 1 shows a partial cross sectional view of an embodiment according to the present invention.

Referring now to FIG. 1, a tubular throttle body 1 having a vertical cross section in the form of an inverse L is removably connected with a branch of an intake manifold and a heat riser stove (not shown) to form a portion of an intake passage.

In the passage of the throttle body 1 a throttle valve 2 and an air flow meter 3 are mounted. An air regulator 4, fuel jetting valve 5 and pressure regulator 6 are secured on the outer wall thereof.

The air flow meter 3 may be a Kärmän vortex type flow sensor located upstream of the throttle valve 2. The amount of air inspired is measured with the flow sensor and is signaled to a control unit (not shown).

The air regulator 4 has an air inlet opening 7 located upstream of and close to the throttle valve 2 and another opening for an air passage outlet 8 located downstream of the throttle valve 2 in order to supply air required while the engine is warming up, by bypassing the throttle valve 2.

The fuel jetting valve 5 is located at the lower portion of the pressure regulator 6 and there is a nozzle 9 of the fuel jetting valve 5 at a position facing the air passage outlet 8 of the aforementioned air regulator 4. It is preferable that the air passage outlet 8 opens on a line which is on an extension of the center axis of the fuel jetting valve.

An atomizer 10 is mounted on a support 10*a* on the inner wall of the throttle body 1 close to the air passage outlet 8 of the air regulator 4. A reflecting surface 10*b* of the atomizer 10 is mounted between the air passage outlet 8 and the nozzle 9 of the fuel jetting valve 5 so as to face the nozzle 9.

Figure 2:
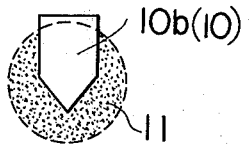
FIG. 2 is a longitudinal cross sectional view taken along the line of A—A in FIG. 1.

As shown in FIG. 2, the reflecting surface 10*b* intercepts about half of the sprayed or jetted fuel which portion forms fuel particles due to the action of the atomizer 10. The atomization of the remaining fuel 11 passing around the reflecting surface 10*b* is effected by air fed from the air passage outlet 8 of the air regulator 4. The atomizer 10 may be operated by ultrasonic vibration or electromagnetic vibration.

Figure 3:
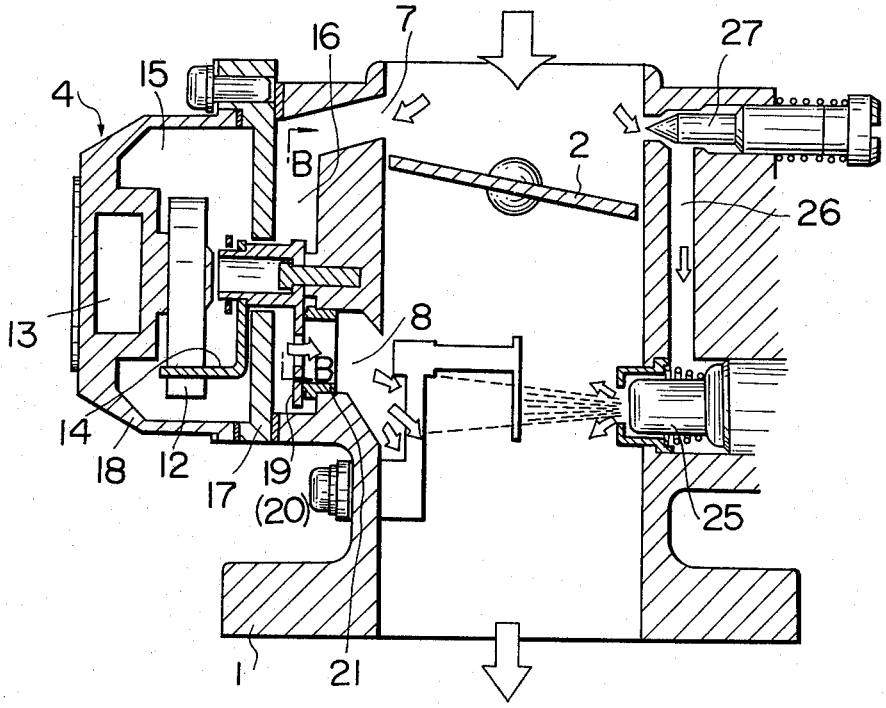
FIG. 3 is a detailed longitudinal cross sectional view of a portion of FIG. 1.

As shown in FIG. 3 the air regulator 4 is composed of a heater and a coiled bimetal 12. The coiled bimetal 12 controlling the opening amount of the air regulator 4 in response to the engine temperature is housed in a chamber 15 along with a lever 14. The chamber 15 is composed of an insulator 17 for separating the same from air passage or bypass 16, and a "thermo-cover" 18 supporting the heater 13 to secure the same on the throttle body 1. The coil bimetal 12 is connected through the lever 14 to a shutter 20 having a fan-shaped valve body 19.

The position of the opening 22 in the valve body 19 regulates the amount of air flowing through the bypass 7 into the air outlet 8.

Figure 4:
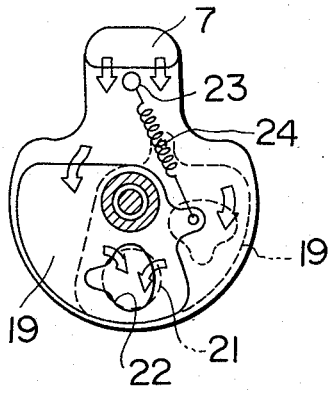
FIG. 4 is a longitudinal cross sectional view of a portion of FIG. 3.

As shown in FIG. 4, the force of a spring 24 attached between the valve body 19 and a fixed pin 23 mounted on the throttle body 1 tends to rotate the valve 19 in the direction of the broken line as shown in the drawing. On the other hand, the force of the coil bimetal 12 exerted on the valve 19 through the lever 14 aligns the shutter opening 22 with the tube 21 when the engine is cold, allowing air to bypass the throttle valve through the outlet 8. At this time the valve body 19 is located at the position of the solid line in FIG. 4.

The electric heater 13 is energized when the engine is started and by heating the bimetal coil 12 act to rotate the valve 19 of the shutter 20 in the direction shown by the broken line in FIG. 4, closing down the air passage outlet 8 after a predetermined time has elapsed.

This function allows air required for warming up to be fed to the combustion chambers. It is possible to make the air regulator 4 used in this embodiment smaller than the prior art devices and it may easily be secured on the outside of the throttle body 1 next to the throttle valve 2 because the coil bimetal 12 is relatively small in comparison with its driving range.

Also, separation of the bimetal chamber 15 from the air passage by the thermal insulator 17, prevents the bimetal from being cooled by air passing therethrough, avoiding problems of inaccuracy.

In addition, as shown in FIG. 3, the use of a relatively narrow annular air passage 25 around and in the neighborhood of the nozzle 9 of the fuel jetting valve 5, in conjunction with an air passage opening 26 upstream of and in the neighborhood of the throttle valve 2 and an adjusting screw 27 controlling the amount of air drawn into the opening of the air passage 26 results in improved atomization of fuel sprayed from the fuel jetting valve 5 by action of the air passing through the annular air passage 25 at a sonic rate or so.

Figure 5:
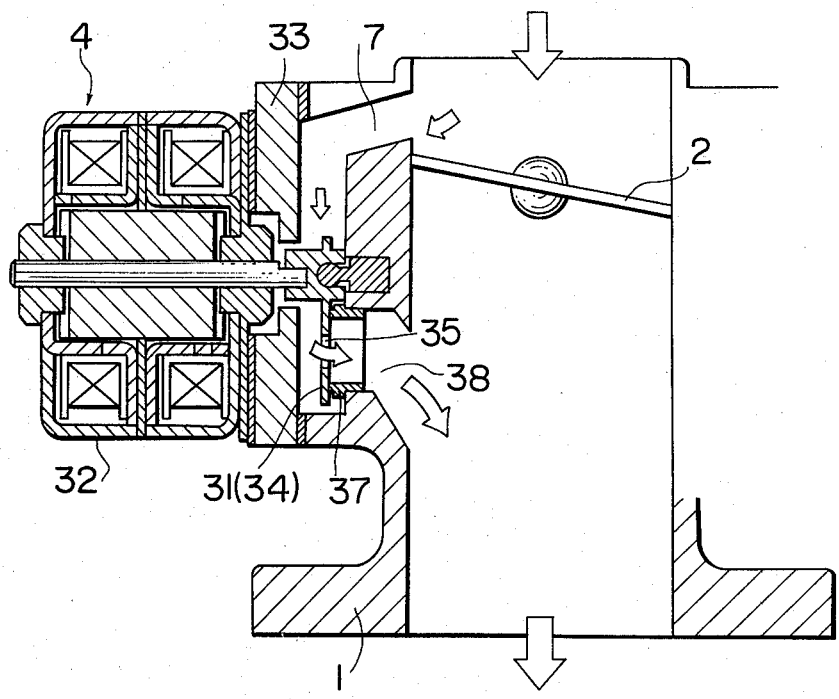
FIG. 5 is a longitudinal cross sectional view of another embodiment according to the present invention.
Figure 6:
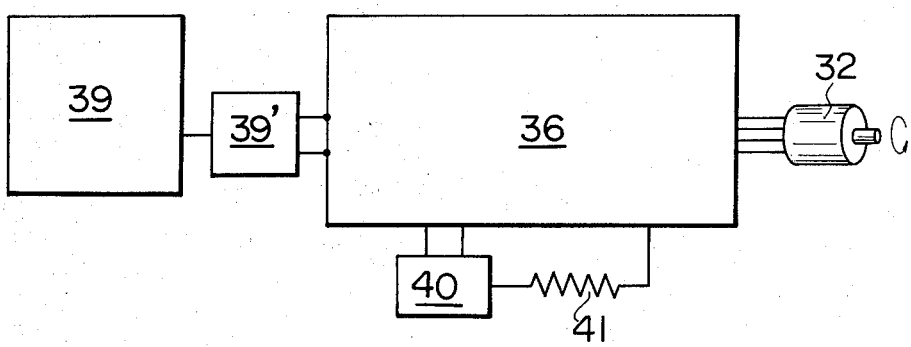
FIG. 6 shows a circuit for driving the step motor shown in FIG. 5.

FIGS. 5 and 6 show another embodiment using a step motor in place of the air regulator 4 as shown in FIG. 1.

As will be seen in FIG. 5, a step motor 32 driving a valve 31 is mounted on the throttle body 1 through a spacer 33. This valve 31 corresponds to the valve 19 in FIG. 3 and other parts of this air passage are similar to those in FIG. 3. The fan-shaped valve body 34 of the valve 31 has an opening 35 for opening the valve. The signals sent from a suitable control circuit 36, which will be described later, control the angle of rotation of the step motor 32, the angle being predetermined so that again, the opening 35 of the shutter 31 aligns with the air passage outlet 36 through a tube 37 when the engine is cold.

Upon starting the engine, the step motor 32 gradually rotates depending on the output of the control circuit 36 generating a signal in accordance with a warming up state to rotate the shutter 31 connected with the step motor 32. Thus the opening 35 begins to shift itself from the opened position of the tubular sheet 37 and closes the air passage at an appropriate time when a predetermined conditions reach, thereby to finish increasing the amount of air required for the warming up operation.

As shown in FIG. 6, the control circuit 36 controls the rotation angle and the rotation speed of the step motor 32 so as to comform with predetermined conditions, through the pulse generator 39' on the basis of the output of respective sensors 39 detecting operating conditions such as engine speed, water temperature, air temperature, atmospheric pressure and the like, thereby to output a pulse signal with the step motor 32 from the pulse generator 39'.

The step motor 32 rotates while being controlled according to the pulse signal. A power source 40 and an external series resistance 41 are connected with the control circuit 36. The air regulator 4 has an extremely good controlability due to the fact that the step motor 32 as noted above is used and the step motor may easily be assembled with the throttle body 1 because it can be relatively miniaturized.

In the drawings, the arrows show the direction of air flow. The fuel feeding device as above-mentioned according to the present invention has such an advantage that the fuel used may sufficiently be atomized to enable to improve performances such as mixed gas distributability, response of the engine and the like by the collision of the fuel jetted from the nozzle 9 of the jetting valve 5 and a large amount of air (500–1000 l/min.) sent from the air passage outlets 8 and 36 especially at a cold starting due to the fact that there are provided the air passage outlets 8 and 38 of the air regulator 4 at the location facing to the nozzle 9 of the jetting valve 5. Further, such disadvantageous phenomenons as miss fire and back fire caused at low temperatures, those being a problem in a prior art fuel feeding device of single point injection type, may be eliminated and good performance of the engine may be obtained.

In addition, the cooling of the coil bimetal 12 caused by air inspired may be avoided by controlling the opening degree of the air regulator 4 through the coil bimetal 12 functioning in proportion to the temperature of the engine used and by providing the insulator 17 between the bimetal chamber 15 for housing the coil bimetal 12 therein and the bypass 16 for the air regulator 4 and the coil bimetal can sufficiently function. Further, due to the fact that the coil bimetal enables to make the driving range large, a wider control area may be obtained and it can be easily assembled with the throttle body 1 by miniaturing same. Furthermore, extremely good controlability of the air regulator 4 may be obtained by controlling the opening degree of the air regulator 4 through the step motor 32 to drive the motor 32 through the control circuit 36 detecting operation conditions. It can also be easily carried out to assemble the step motor with the throttle body 1 because the step motor 32 can be considerably miniaturized.

Further, the atomization of the fuel used may considerably be improved to obtain a constant ideally atomized state of the fuel during the period of operating the engine by providing the atomizer 10 in the intake passage between the air passage outlet 8 of the air regulator 4 and the nozzle 9 of the fuel jetting valve 5 or by connecting the annular air passage 25 provided around and close to the nozzle 9 of the jetting valve 5 with the upstream of the throttle valve 2.

Figure 7:
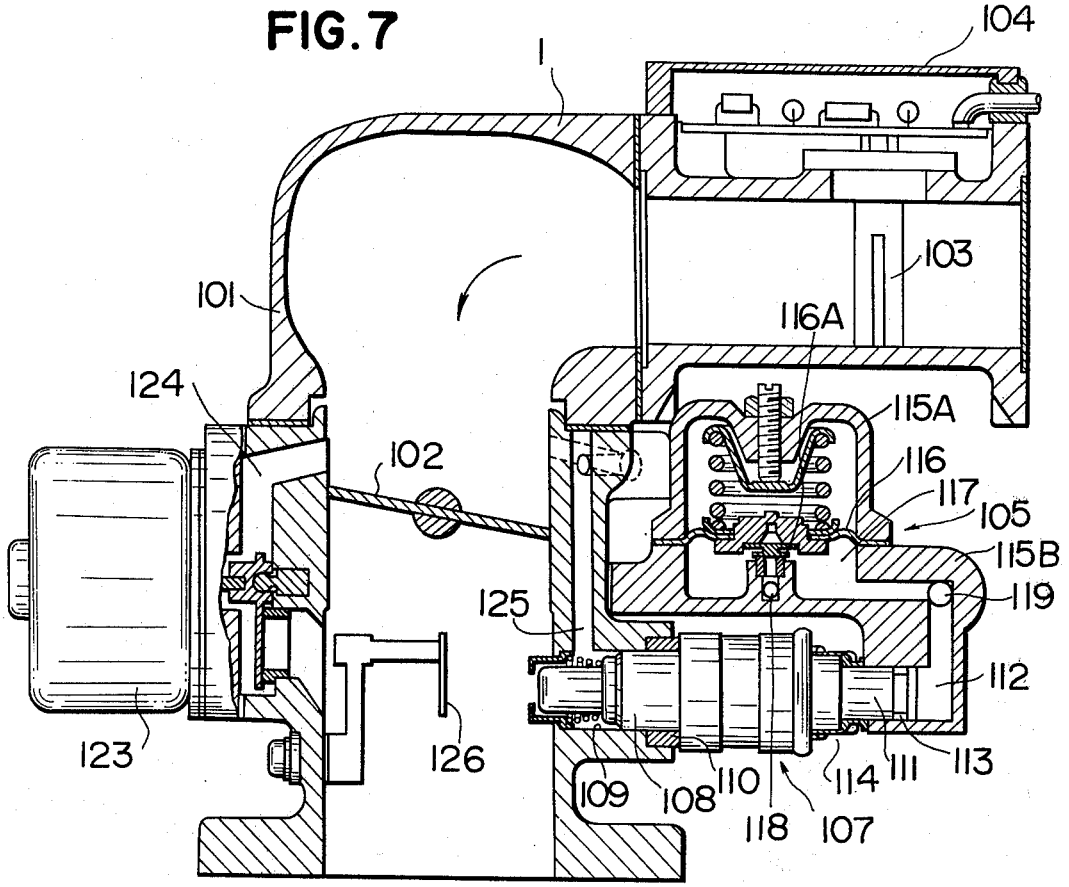
FIG. 7 is a cross sectional view of a fuel feeding device according to a further embodiment of the present invention.
Figure 8:
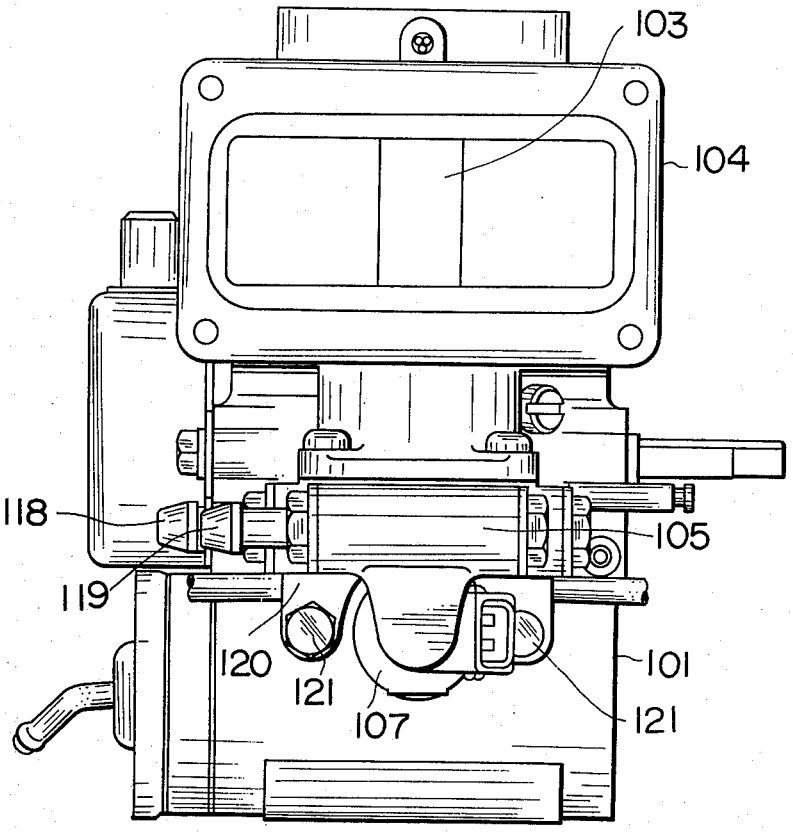
FIG. 8 is a side view of the device as shown in FIG. 7.

FIG. 7 shows another embodiment of this invention in which a throttle body 101 constitutes a portion of an intake pipe, and a sensor body 104 for a sensor 103 used for detecting the amount of air inspired is connected with the upper stream of a throttle valve 102.

The pressure regulator 105 is integrally fixed to the side surface of the throttle body 101 and a fuel jetting valve 107 is mounted between the pressure regulator 105 and the throttle body 101 in such a manner that the both ends are held therebetween, completely and fixedly supporting the valve 107.

The nozzle tip 108 of the fuel jetting valve 107 is inserted within a fitting hole 109 in the throttle body 101 through an annular rubber sealing ring 110 and a fuel inlet valve 111 is inserted into a fuel feeding passage 112 assembled with the pressure regulator 105 in the axial direction thereof to be sealed through a O-ring 113 and an annular rubber member 114.

Accordingly, the fuel jetting valve 117 is longitudinally supported by the two annular rubber members 110 and 114 with appropriate elasticity to securely avoid fuel leakage.

The body of the pressure regulator 105 has been separated into an upper body 115A and a lower body 115B by the barrier of a diaphragm 116 but these two bodies are combined with bolts to be assembled with each other.

In the lower body 115B, there is formed a fuel chamber 117, a fuel return passage 118, an inlet passage 119 and the fuel feeding passage 112 noted above. The lower body 115B has been combined with the throttle body 101 with fitting bolts 121 for a bracket 120 in the axial direction of the fuel jetting valve 107.

When mounting the fuel jetting valve 107, the lower body 115B may be mounted on the throttle body 101 in such a manner that the fuel inlet pipe 111 is inserted into the fuel feeding passage 112 after the nozzle tip 108 has been inserted in the fitting opening 109.

At that time, the fuel feeding passage 112, which also acts as a hole supporting the fuel jetting valve 107, is previously formed so that the axial direction of the jetting valve and the axis of same are conformed with each other.

As similar to those in FIGS. 1 to 6, designated at 123 is an air regulator integrally mounted on the throttle body 101 and it makes air flow through a passage 124, which is a bypass of the throttle valve 102 and closes the passage after warming up operation has been finished. A passage of air used for atomizing the fuel required for idling the engine and required at low speed operation of same, jetted from the nozzle tip 108 of the fuel jetting valve 107 is designated at 125. Designated at 126 is an atomizer which enhances uniform distributability of a mixed gas and accelerates atomization of the fuel jetted. Such are substantially the same as those in FIG. 1.

In the construction noted above, the fuel jetting valve 107 opens or closes depending upon a pulse signal indicating a jet of fuel and sent from a control circuit (not shown).

When the valve opens, a fuel having been pressurized by the pressure regulator 105 is jetted from the nozzle tip 108 into air inspired.

In the pressure regulator 105, a diaphragm valve 116A controls the opening degree of the return passage 118 so that the fuel sent from the inlet passage 119 is controlled at a pressure set by the diaphragm 116.

In such a manner, the fuel supply pressure in the feeding passage 112 may be maintained at a predetermined value and the amount of fuel flowing therein is accurately proportional to the opening time of the jetting valve 107.

The fuel jetting valve 107 has resistance to mechanical vibrations and completely eliminates dangers such as fuel leakage because of the fact that it is held between the body 115B of the pressure regulator 105 and the throttle body 101 to be fixed therebetween and is directly connected with the fuel feeding passage 112.

As noted above, dangers such as fuel leakage may completely be avoided because a pressure regulator and a fuel jetting valve may be connected with each other without using rubber hoses lacking in reliability as a fuel pipe or steel pipes having welded portions and further, special supporting members are not required and it is possible to improve workability at fitting time, to lessen the number of parts used and to reduce cost for production because of the fact that the fuel jetting valve is fitted in interposed fashion by the use of a pressure regulator integrally assembled with a throttle body.

The invention may be embodied in other specific forms without departing from the spirit or essential characteristics thereof. The shown and described embodiments are therefore to be considered in all respects as illustrative and not restrictive, the scope of the invention being indicated by the appended claims rather than by the foregoing description and appended drawings, all changes which come within the meaning and range of equivalency of the claims are therefore intended to be embraced therein.

What is claimed is:

1. A fuel feeding device for a multi-cylinder type internal combustion engine, comprising:

a tubular throttle body having an intake passage;

a throttle valve provided within said intake passage;

a bypass formed around said throttle valve, said bypass having an air passage inlet to said intake passage upstream of said throttle valve and an air passage outlet to the intake passage downstream of said throttle valve;

an air regulator for regulating air flow through said bypass;

a valve having a nozzle for injecting fuel into said intake passage downstream of said throttle valve; and an atomizer located near said air passage outlet, said atomizer having at a base portion thereof a support portion fixed to said tubular throttle body said atomizer further having a reflecting planar surface disposed between said air passage outlet and said nozzle of said fuel injecting valve, said nozzle facing said reflecting planar surface.

2. A fuel feeding device of claim 1, wherein said reflecting planar surface intercepts about half of the injected fuel which half forms fuel particles due to the action of said atomizer so that the atomization of the remaining fuel not intercepted by said reflecting planar surface can be effected by air fed from said air passage outlet.

3. A fuel feeding device of claim 1 or 2, wherein said atomizer is operated by ultrasonic vibration.

4. A fuel feeding device of claim 1 or 2, wherein said atomizer is operated by electromagnetic vibration.

5. A fuel feeding device of claim 1 or 2, further comprising:

an annular air passage around and in the neighborhood of said nozzle of said fuel injecting valve;

an air passage connected at one end with said annular air passage and at its other end to said intake passage upstream of said throttle valve; and an adjusting screw means for controlling the amount of air drawn into said annular air passage so that the atomization of fuel sprayed from said nozzle of said fuel jetting valve can be improved by the action of the air passing through said annular air passage.

6. A fuel feeding device of claim 5, wherein the air passes through said annular air passage at a sonic velocity.

* * * * *